US005685541A

United States Patent [19]

Lovell, Sr.

[11] Patent Number: 5,685,541

[45] Date of Patent: Nov. 11, 1997

[54] MULTIPLE-FIELD GAME CARD HAVING REMOVABLE COATING

[75] Inventor: John G. Lovell, Sr., Sevierville, Tenn.

[73] Assignee: Stuart Entertainment, Inc., Council Bluffs, Iowa

[21] Appl. No.: 621,991

[22] Filed: Mar. 26, 1996

[51] Int. Cl.[6] ..... A63F 3/06

[52] U.S. Cl. ..... 273/139; 273/269

[58] Field of Search ..... 273/269, 139, 273/138.1; 463/18, 19

[56] References Cited

U.S. PATENT DOCUMENTS

| | | | |
|---|---|---|---|
| 4,540,175 | 9/1985 | Coppock | 273/139 |
| 4,738,473 | 4/1988 | Meloni | 283/903 |
| 5,005,840 | 4/1991 | Schwartz | 273/269 |
| 5,074,566 | 12/1991 | Desbiens | 273/269 |
| 5,092,598 | 3/1992 | Kamille | 273/139 |
| 5,118,109 | 6/1992 | Gumina | 273/139 |
| 5,193,815 | 3/1993 | Pollard | 273/269 |
| 5,386,985 | 2/1995 | Paris | 273/269 |
| 5,544,881 | 8/1996 | Rua, Jr. et al. | 273/139 |
| 5,560,608 | 10/1996 | Silverschotz | 273/139 |

FOREIGN PATENT DOCUMENTS

| | | | |
|---|---|---|---|
| 0621061 | 10/1994 | Austria | 273/269 |
| WO9408673 | 4/1994 | Finland | 273/269 |

*Primary Examiner*—Benjamin H. Layno
*Attorney, Agent, or Firm*—Pitts & Brittian, P.C.

[57] ABSTRACT

A multiple-field game card is provided having a plurality of concealed caller's areas having concealed symbols therein. The playing card is additionally provided with at least one playing area having at least one matrix adapted to playing BINGO. In normal play, a player selects one of the caller's areas and reveals concealed windows in an attempt to match the concealed symbols with a winning combination symbols in the playing area. In accordance with the present invention, each game card contains at least one winning combination of symbols and the player's ability to win is limited only by the player's ability to successfully reveal winning symbols.

6 Claims, 3 Drawing Sheets

MULTIPLE-FIELD GAME CARD HAVING REMOVABLE COATING

This application in part discloses and claims subject matter disclosed in my earlier filed pending application, Ser. No. 08/404,321 which was filed on Mar. 15, 1995.

TECHNICAL FIELD

This invention relates to the field of game cards. More specifically, it relates to a game card having a plurality of concealed calling areas one of which includes a winning combination of game symbols, wherein each card provides the player a guaranteed win if the correct concealed calling area is revealed.

BACKGROUND ART

The sale of game cards has become a profitable enterprise and numerous types of game cards are known in the art. Typically, a game card has a concealed window that contains indicia that, when revealed, indicates whether the card is a winning or a losing card. This can be indicated simply with an indication that a card either is or is not a winning card. Often a plurality of symbols are concealed, and a designated symbol that must be matched is not concealed. The player is allowed to reveal one or more of the concealed windows in an attempt to reveal a symbol that matches the designated symbol. The concealed symbols can be concealed in one of several known methods. A game card can be of the "break-open" variety in which the concealed window is revealed by removing a perforated portion of a laminar card. The concealed window can also be concealed with a removable coating that is removed by scratching.

U.S. Pat. No. 4,540,175, issued to C. Wallace Coppock on Sep. 10, 1985, discloses a game of chance having rows and columns of spaces containing randomly placed symbols which are concealed. Players attempt to match a called symbol by revealing a chosen space.

U.S. Pat. No. 4,738,473, issued to Robert Meloni, et al. on Apr. 19, 1988, discloses a ticket with a scratch-off coating and a method for securely fabricating such a ticket at the point of sale.

U.S. Pat. No. 5,074,566, issued to Jean Desbiens on Dec. 24, 1991, discloses a two level scratch game card. Desbiens's card has a first grid with randomly selected numbers printed thereon. A scratch-off coating is applied and a second grid, having identical numbers in the same locations as the first grid, is imprinted thereon. The scratch-off coating conceals hidden prizes which are imprinted within the first grid. The card is useful in providing a Bingo type card during which a player, while attempting to win in standard Bingo fashion, has the possibility of winning the hidden prize or prizes.

U.S. Pat. No. 5,092,598, issued to Kamille on Mar. 3, 1992, discloses a multivalue-multiplay lottery game card that incorporates player determination of the level of risk engaged as well as attributes of prize control. In one embodiment, Kamille's game incorporates the use of a printed game card piece with a removable covering means for the fields of play.

U.S. Pat. No. 5,118,109, issued to Anthony Gumina on Jun. 2, 1992, discloses an instant poker game card having portions thereof covered with a removable scratch-off coating, which when removed, reveals symbols indicating the cards of a poker hand.

U.S. Pat. No. 5,193,815, issued to Pollard on Mar. 16, 1993, discloses a bingo card for playing an instant bingo game which has a single caller's area in which bingo numbers are printed and covered by an opaque layer which can be scratched away. Pollard's card has a single concealed area referred to as the "Caller's area". Typical bingo numbers, i.e. "-B3-" or "-O75-" are revealed by removing the opaque covering in the caller's area. A second area is comprised of typical bingo card matrices. As a number is revealed in the caller's area, the player checks the second area to see if there is a match. The matching number is marked by removing the translucent marking over that number.

Similarly, U.S. Pat. 5,386,985, issued to Paris on Feb. 7, 1995, discloses a bingo type playing card that incorporates a single caller's area. U.S. Pat. No. 5,005,840, issued to Schwartz on Apr. 9, 1991, discloses a bingo game having a card distributed with a video-cassette in which is embedded the gaming numbers or other gaming indicia associated with BINGO. European Patent Application 0621061, published on Oct. 26, 1994, discloses a BINGO type card, similar to Pollards, that includes a single caller's area. And, PCT application, WO 94/08673, published on Apr. 28, 1994, discloses a bingo type game card having a single caller's area.

It will be appreciated by those skilled in the art that having a single caller's area limits the player's choices and, thus, the player's control of the play of the game is limited. What is needed is a bingo type game card in which a plurality of concealed caller's areas are provided. By giving the player a choice of calling areas from which to choose to play, the player has an enhanced perception of involvement in the play of the game. Further, the player should have the assurance that, for any given card played, the player can win a prize if the player selects and reveals the correct caller's area.

Accordingly, it is an object of this invention to provide a BINGO type game card having a plurality of concealed calling areas.

Another object of the present invention is to provide a BINGO type game card that has at least one BINGO matrix playing area.

A further object of the present invention is to provide one concealed calling area with a winning combination of symbols.

Still a further object of the present invention is to provide a game card in which each game card offers the player the potential of winning.

Other objects and advantages over the prior art will become apparent to those skilled in the art upon reading the detailed description together with the drawings as described as follows.

DISCLOSURE OF THE INVENTION

In accordance with the various features of this invention, a BINGO type playing card is provided having a plurality of concealed calling areas having concealed symbols or gaming indicia therein. The playing card is additionally provided with at least one playing area with gaming symbols and/or gaming indicia therein. In the preferred embodiment, the gaming symbols are typical BINGO indicia and the playing area is in the form of a bingo matrix. In normal play, a player reveals concealed windows in an attempt to match the gaming indicia, i.e. BINGO numbers, with the indicia in the playing area, in order to score a "BINGO" in a typical, or predesignated manner.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
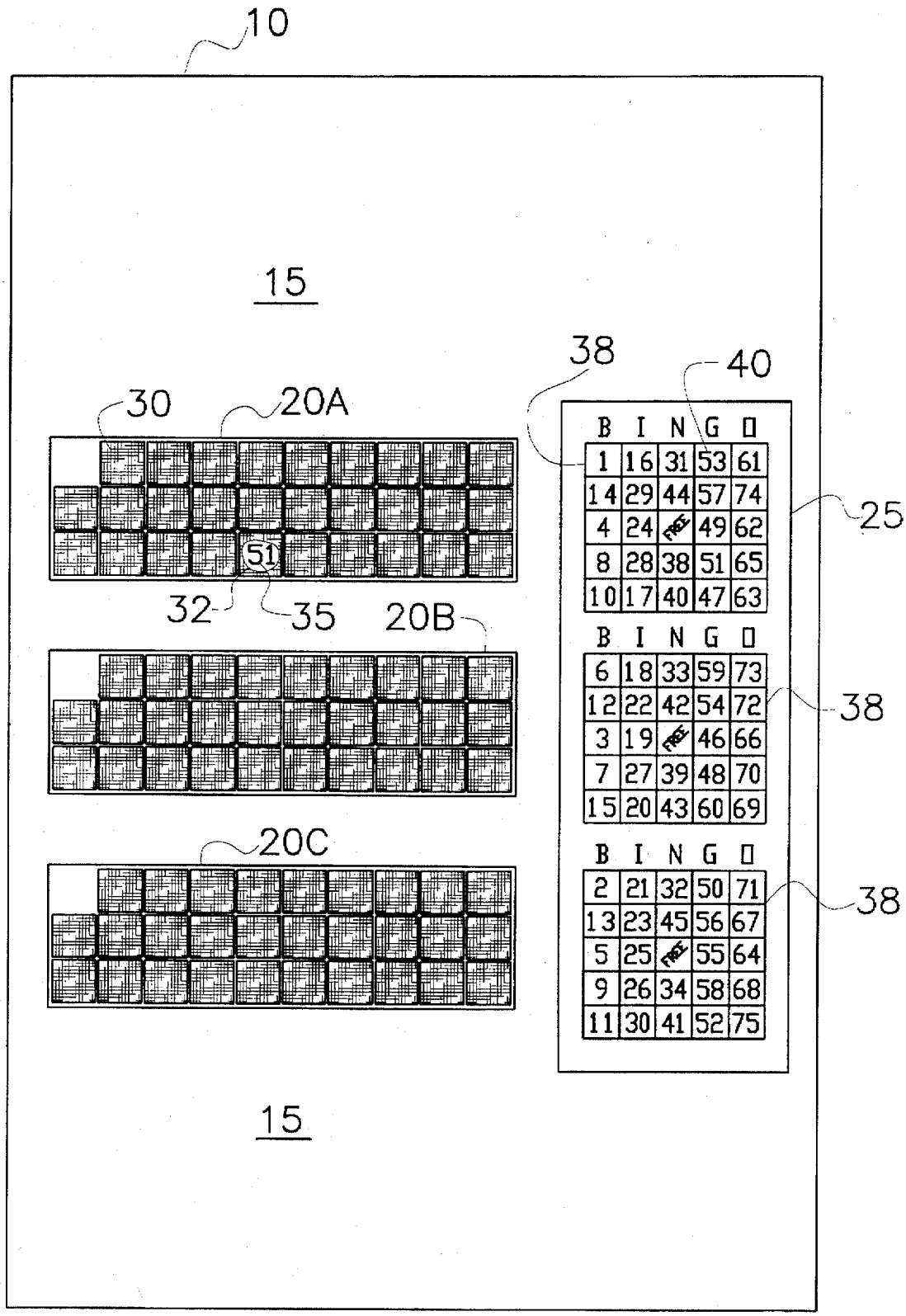
FIG. 1 illustrates a plan view of one embodiment of the game card of the present invention adapted to playing a form of bingo.

A multiple-field game card having a plurality of concealed calling areas constructed in accordance with the present invention is illustrated generally as 10 in the figures. Game card 10 is planar, is preferrably constructed of cardstock, and has a plurality of indicia areas 15. Those skilled in the art will recognize that indicia areas 15 will contain printed messages, such as, though not limited to, card identifiers for identifying the card to the player, printed rules of playing the card and explanation as to what constitutes a winning play, and prize levels. Those skilled in the art will also readily recognize that the back of card 10, (not shown), can also define an indicia area.

In addition to indicia areas 15, game card 10 also includes a plurality of caller's areas 20, such as caller's areas 20A, 20B, and 20C. Game card 10 further includes a playing field 25. In the preferred embodiment, caller's area 20 has a plurality of concealed tiles 30 that are concealed by a removable coating 32 that is removed by scratching. Such coatings are readily known in the art and are readily available in varieties that can be scratched off with a fingernail and varieties that require a harder scratching instrument, such as the edge of a coin. Those skilled in the art will recognize that concealed tile 30 can be of any geometric shape. Removable coating 32 conceals a symbol 35. In the preferred embodiment, symbol 35 corresponds to a BINGO number. Those skilled in the art will recognize that a standard BINGO game utilizes numbers 1–75.

Figure 2:
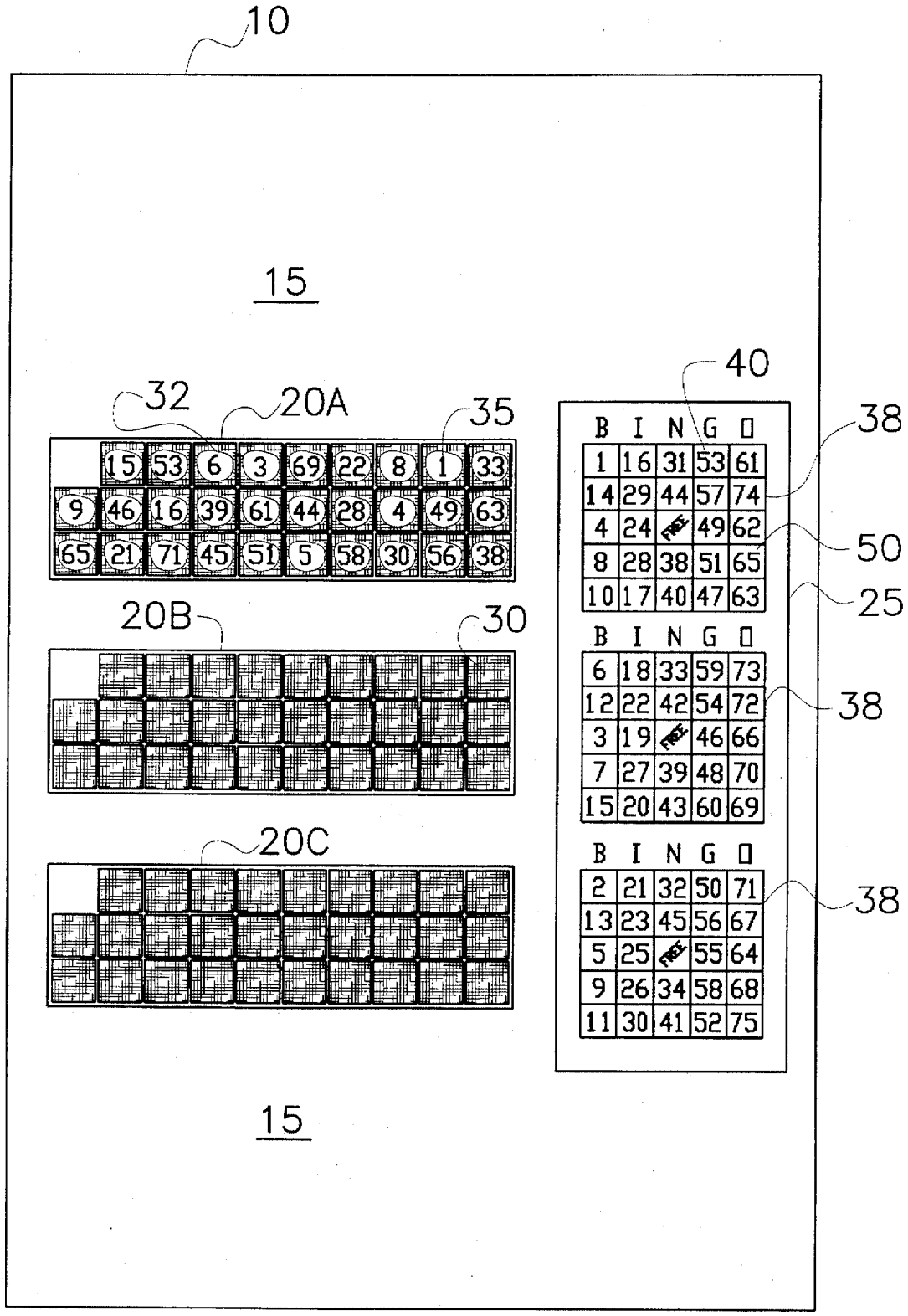
FIG. 2 illustrates a plan view of the embodiment shown in FIG. 1, showing a winning combination of game indicia revealed in a caller's area.
Figure 3:
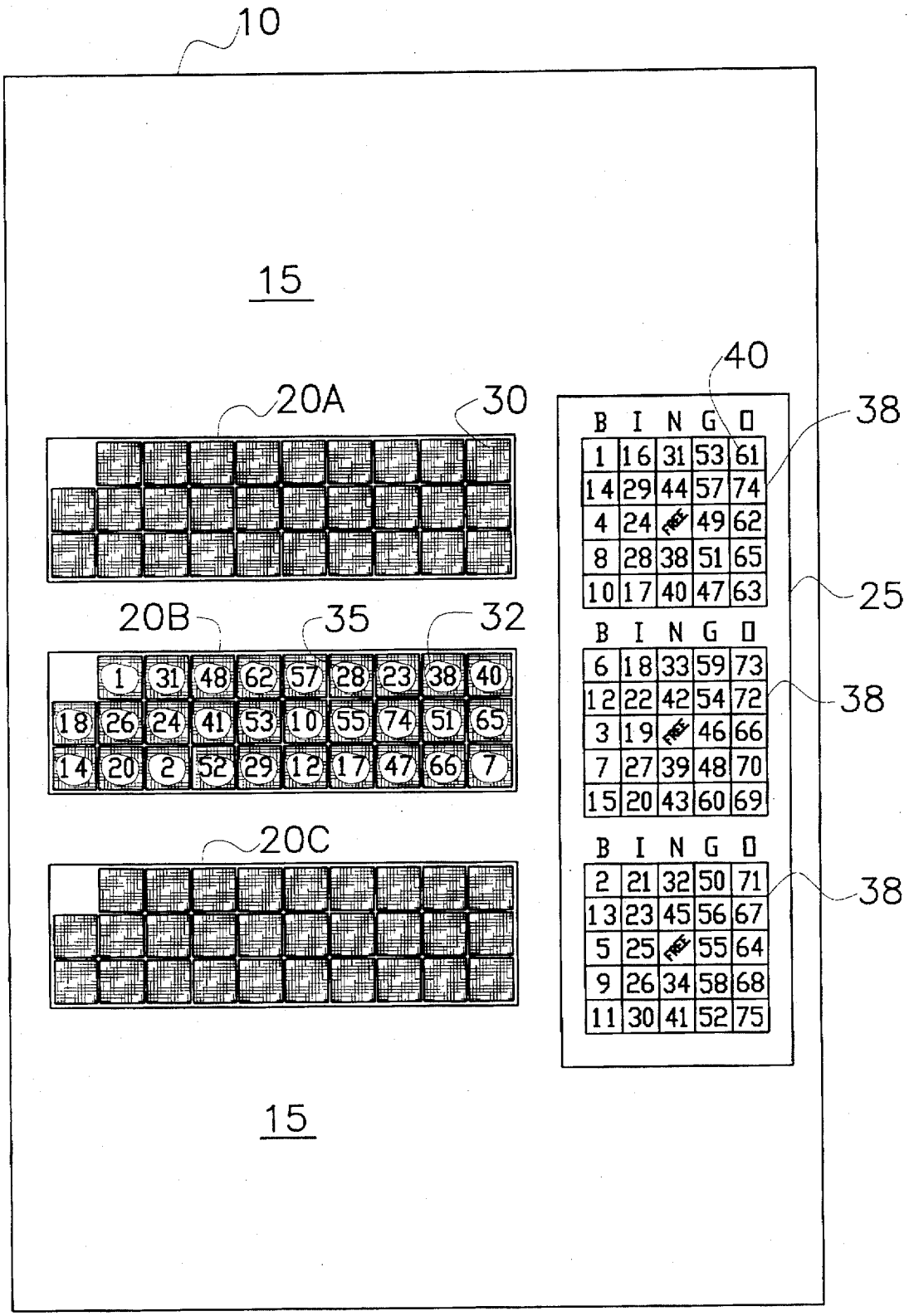
FIG. 3 illustrates a plan view of the game card shown in FIG. 1, showing a losing caller's area with its combination of game indicia revealed.

Further, in the preferred embodiment, playing field 25 contains at least one BINGO matrix 38. It will be further recognized by those skilled in the art that a standard bingo matrix consists of 5 columns of grid squares. The columns are identified respectfully as "B", "I", "N", "G" and "O", and 5 rows, with the numbers 1–15 being associated with the "B" column; numbers 16–30 being associated with the "I" column; numbers 31–45 being associated with the "N" column; numbers 46–60 being associated with the "G" column and numbers 61–75 being associated with the "O" column. Game card 10 is played by selecting a calling area 20 from calling areas 20A, 20B and 20C to be played. The player then removes coating 32 from each concealed tile 30 thus revealing symbols 35. The player then marks any matching BINGO numbers 40 within BINGO matrix 38 in a manner similar to a typical, live-action BINGO game. In FIGS. 2 and 3, the matched BINGO numbers 40 are marked with stipling. In accordance with the teachings of the present invention, a player is assured that concealed tiles 30, within a predesignated calling area 20, contain at least one combination of symbol 35 that corresponds to a winning combination of BINGO numbers 40 in playing area 25. In this manner, a player is assured that every card is potentially a winning card, limited only by the player's ability to correctly reveal the winning combination.

For instance, as illustrated in FIG. 2, a player has selected and played calling area 20A and has revealed each of the symbols 35 contained within the tiles 30 of calling area 20A. Certain of the symbols 35 match the BINGO numbers 40 printed within row 50, i.e. "B8", "I28", "N38", "G51" and "O65", thus, this player has achieved a BINGO and has correctly chosen the winning calling area. In contrast, as seen in FIG. 3, a player has selected and played calling area 20B. None of the revealed symbols 35 have a winning combination of matching BINGO numbers in playing area 25. Those skilled in the art will recognize that while the winning combination depicted in FIG. 2 is defined by a horizontal line of "called" numbers, i.e. "B8", "I28", "N38", "G51" and "O65", any typical BINGO combination could constitute a winning combination.

While the embodiment illustrated in FIG. 1, shows game card 10 having a single playing field 25 having a plurality of BINGO matrices, those skilled in the art will recognize that game card 10 could be provided with a plurality of playing fields 25 each having a single BINGO matrix or alternatively, could be provided with only a single BINGO matrix. Further, in the embodiment depicted in FIGS. 1–3, caller's areas 20A, 20B, and 20C, have equal number of concealed tiles 30, however, caller's area 20A could have a greater number of concealed tiles 30 than does caller's area 20B and likewise caller's area 20B could have a greater number of concealed tiles than does caller's area 20C, thus presenting the appearance that a caller's area 20 with greater game tiles 30 has a greater probability of being a winner. Moreover, whereas FIG. 1 depicts all of the symbols as being revealed, in one embodiment of the game, the value of the prize would be inversely proportional to the number of symbols revealed in attempting to find a winning combination. In the preferred embodiment, one caller's area 20 would be a predetermined winner, i.e. the symbols 35 revealed by removing coating 32 would match BINGO numbers 40 within one of the BINGO matrices in any conventional bingo pattern, or in any predetermined pattern.

From the foregoing description, it will be recognized by those skilled in the art that a multiple-field game card offering advantages over the prior art has been provided. Specifically, the multiple-field game card provides a game card, which has a plurality of concealed caller's areas. Further the present invention provides a game card in which each game card offers the player the potential of winning limited only by the player's ability to correctly reveal concealed winning symbol combinations.

It will be recognized by those skilled in the art that, while a BINGO type card has been described, various embodiments of cards can be adapted to the present invention. In this regard, players could be required to match a specific symbol in order to win. Players could be required to match a plurality of symbols in a manner similar to other games of chance such as keno, baccarat, poker or blackjack.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A multiple-field game card for playing a game of chance, said game card comprising:

a card member having indicia areas disposed thereon for identifying said multiple-field game card and for providing player instruction wherein said indicia areas include printed rules of playing said game card, rules for explaining what constitutes a winning play, and prize levels, said card member including at least two sections;

a first section having a playing field area, wherein said playing field area includes indicia defining a plurality of matrices, each said matrix including five columns of five rows of grid squares, each said grid square including a game symbol defined by a number therein, wherein each said matrix is adapted for playing the game of bingo, each said game symbol being a bingo number in a range of 1–75, wherein a portion of said game symbols in one of said matrices forms a combination of game symbols; and a second section having a plurality of caller's areas from which a player selects one such caller's area for play, each said caller's area includes a plurality of concealed game symbols, said game symbols being defined by bingo numbers, one of said caller's areas including a combination of game symbols that corresponds with said combination of game symbols included in one of said matrices field said first section in a predetermination manner consistent with the rules of bingo, thus defining a winning combination of said game symbols in said one caller's area, wherein said one caller's area including a winning combination of game symbols defines a winning caller's area, wherein said player shall win a prize upon selection of said winning caller's area and playing said game of chance.

2. The multiple-field game card of claim 1 wherein said concealed symbols are concealed by a covering defined by a coating that is readily removable by scratching.

3. The multiple-field game card of claim 1 wherein said card member is constructed of cardstock.

4. The multiple-field game card of claim 1 wherein said card member is planar.

5. A multiple-field game card for playing a game of chance, said game card comprising:

a planar card member having indicia areas disposed thereon for identifying said multiple-field game card and for providing player instruction wherein said indicia areas include printed rules of playing said game card rules for explaining what constitutes a winning play, and prize levels, said card member including at least two sections;

a first section having a playing field area, wherein said playing field area includes indicia defining a plurality of matrices, each said matrix including five columns of five rows of grid squares, each said grid square including a game symbol defined by a number therein, wherein each said matrix is adapted for playing the game of bingo, each said game symbol being a bingo number in a range of 1–75, wherein a portion of said game symbols in one of said matrices forms a combination of game symbols; and a second section having a plurality of caller's areas from which a player selects one such area for play, each said caller's area includes a plurality of game symbols concealed by a covering defined by a coating that is readily removable by scratching, said game symbols being defined by bingo numbers, one of said caller's areas including a combination of game symbols that corresponds with said combination of game symbols included in one of said matrices of said first section in a pre-determined manner consistent with the rules of bingo, thus defining a winning combination of symbols, wherein said one caller's area including a winning combination of game symbols defines a winning caller's area, wherein said player shall win a prize upon selection of said winning caller's area and playing said game of chance.

6. The multiple-field game card of claim 5 wherein said planar card member is constructed of cardstock.

* * * * *